US007516865B1

(12) United States Patent
Pierre

(10) Patent No.: US 7,516,865 B1
(45) Date of Patent: Apr. 14, 2009

(54) DEODORIZED WASTE RECEPTACLE

(76) Inventor: Reginald Pierre, 245 Wedgewood Cir., Lake Worth, FL (US) 33463

( * ) Notice: Subject to any disclaimer, the term of this patent is extended or adjusted under 35 U.S.C. 154(b) by 527 days.

(21) Appl. No.: 11/274,102

(22) Filed: Nov. 14, 2005

(51) Int. Cl.
*B65D 25/00* (2006.01)

(52) U.S. Cl. ..... 220/87.1; 220/908

(58) Field of Classification Search ..... 220/87.1, 220/87.2, 908
See application file for complete search history.

(56) References Cited

U.S. PATENT DOCUMENTS 2,434,238 A * 1/1948 Wolfson ..... 220/87.2
3,659,778 A * 5/1972 Saultz et al. ..... 232/43.1
4,902,482 A * 2/1990 Faust ..... 422/121
5,520,303 A * 5/1996 Bernstein et al. ..... 220/495.08
5,758,888 A * 6/1998 Burgan et al. ..... 280/47.34
7,225,943 B2 * 6/2007 Yang et al. ..... 220/263
2002/0051739 A1 * 5/2002 Wang ..... 422/105

* cited by examiner

*Primary Examiner*—Anthony D Stashick
*Assistant Examiner*—Harry A Grosso

(57) ABSTRACT

A waste receptacle for used diapers or other waste product that is equipped with an automatic deodorant dispensing system which only operates when a lid of the receptacle is in a downward or in a closed position.

7 Claims, 2 Drawing Sheets

DEODORIZED WASTE RECEPTACLE

FIELD OF THE INVENTION

The present invention generally relates to an apparatus for storing used diapers or other waste and more particularly, relates to an apparatus for storing used diapers or other waste that is equipped with an automatic deodorant dispensing system which operates only when a lid of the apparatus is in a down position.

BACKGROUND OF THE INVENTION

Diaper is a most frequently used accessory in a home or a daycare facility for babies and toddlers. During the course of a day, a frequent change of diapers is necessary so is a waste receptacle for receiving used diapers. In order to prevent bad odors from spreading into a home or a daycare facility, the waste receptacle for used diapers must be frequently emptied and tightly sealed. It is therefore a tedious task of emptying a waste receptacle for used diapers frequently and for keeping the waste receptacle tightly sealed. For instance, when the waste receptacle is a plastic garbage bag, the bag must be opened and closed with a tie frequently in order to prevent the spreading of bad odor into a house. It is therefore desirable to provide a waste receptacle that is equipment with an efficient odor control system.

It is therefore an object of the present invention to provide a waste receptacle for receiving used diapers or other waste that does not have the drawbacks or shortcomings of the conventional waste receptacles.

It is another object of the present invention to provide a waste receptacle that is equipped with an automatic deodorant dispensing system.

It is still another object of the present invention to provide a waste receptacle that is equipped with an automatic deodorant dispensing system that operates only when the lid for the waste receptacle is in a downward position.

It is yet another object of the present invention to provide a waste receptacle equipped with an automatic deodorant dispensing system that can be pre-set as desired a time interval for activating the dispensing system.

SUMMARY OF THE INVENTION

In accordance with the present invention, a waste receptacle for receiving used diapers or other waste that is equipped with an automatic deodorant dispensing system which operates only when a lid of a receptacle is in a downward position is provided.

In a preferred embodiment, the present invention waste receptacle that is equipped with an automatic deodorant dispensing system is constructed by a receptacle base for receiving waste material in a cavity; a lid pivotably connected to a top portion of the receptacle base for hermatically sealing the cavity; and a deodorant dispensing system that is mounted to a bottom surface of the lid controlled by a tilt switch such that the deodorant dispensing system is operative only when the lid is in a down position.

BRIEF DESCRIPTION OF THE DRAWINGS

The invention will now be described, by way of example, with reference to the accompanying drawings, in which.

DETAILED DESCRIPTION OF THE INVENTION

The present invention discloses a waste receptacle that is equipped with an automatic deodorant dispensing system which is operative only when a lid of the receptacle is in a downward, or closed position. The automatic deodorant dispensing system is controlled by a microprocessor including a timer which may be preset as desired.

The present invention waste receptacle is a modified diaper pail or a garbage pail that has a built-in air freshner, or deodorant dispensing device. The present invention waste receptacle can be advantageously provided in a cylindrical canister shape and can be produced from plastic or metal. The cylindrical canister is provided with a hinged lid with a latch for latching onto the cylindrical canister to provide a hermatic seal. The automatic deodorant dispensing system is mounted to a bottom surface of the lid which may be battery-powered to provide portability of the waste receptacle. The automatic deodorant dispensing system sprays an air freshner, or a deodorant whenever the lid is a closed, i.e. or in a downward position at a preset time interval, i.e., for instance, every 5 or 10 minutes. A variety of scented deodorants can be used to suit the users specific liking.

The present invention waste receptacle for receiving used diapers or other waste provides the benefits of practicality and convenience, as well as automatic operation and the alleviation of bad odors in a home. It effectively eliminates bad odors such as diaper odors or garbage odors due to food scraps in a kitchen. The waste receptacle can effectively keep the bad odors under control. The built-in deodorant dispensing system can dispense a pre-selected deodorant, or air freshner at a preset time interval to generate a pleasant, refreshing smell. The automatic deodorant dispensing system may be activated at every 5, 10 minutes or any time other intervals when the lid of the waste receptacle is closed, i.e. in a downward position. The frequent and automatic distribution of the deodorant alleviates the unpleasant odors and keeps the room smelling clean. The pleasant invention waste receptacle can be advantageously used in a home setting, or in a daycare setting or other institutions that provide care for infants and toddlers, and further by individuals who provide baby-sitting services in their homes.

Figure 1:
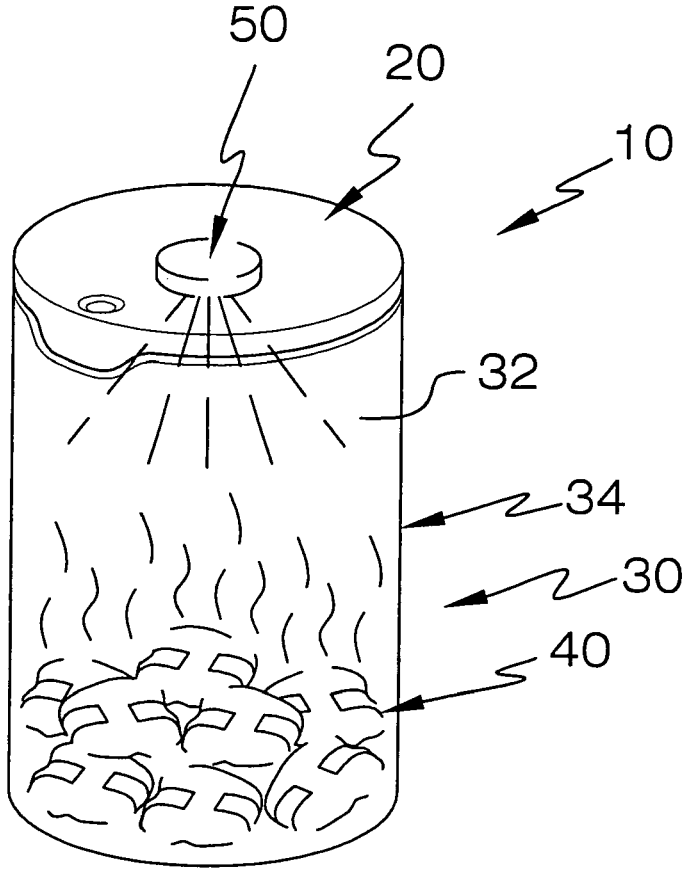
FIG. 1 is a perspective view of the present invention waste receptacle that is equipped with an automatic deodorant dispensing system.

Referring initially to FIG. 1, wherein a perspective view of the present invention waste receptacle 10 is shown. The waste receptacle 10 is equipped with an automatic deodorant dispensing system 50 which is mounted to an underside 22 (FIG. 2) of a lid 20. The waste receptacle 10 is constructed of a receptacle base 34 receiving waste material 40 in a cavity 32 formed by a sidewall 34 of the receptacle base 30.

Figure 2:
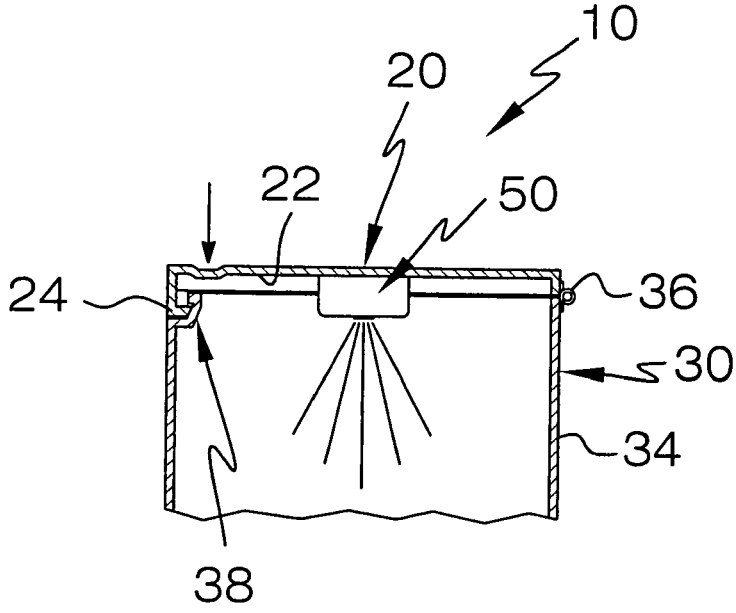
FIG. 2 is a partial, cross-sectional view of the waste receptacle shown in FIG. 1.
Figure 3:
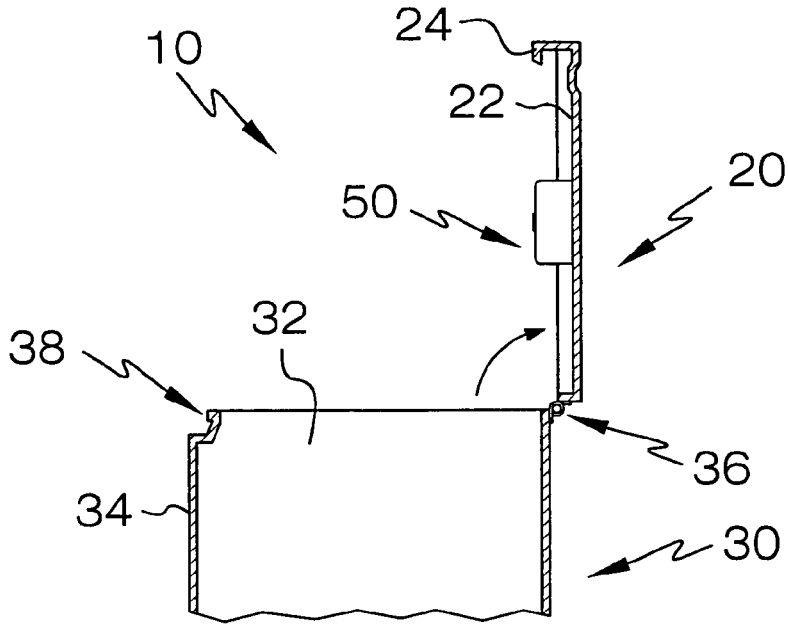
FIG. 3 is a partial, cross-sectional view of the waste receptacle of FIG. 1 with the lid in an upright or open positioned.

The lid 20 is pivotably connected by a hinge 36, shown in FIGS. 2 and 3, that is mounted at a top of the receptacle base 30. The lid 20 provides a hermatic seal of the cavity 32 from the outside environment. The lid 20 further includes a latch 24 that latches onto a catch 38 provided on the sidewall 34 of the receptacle base 30. A plastic lining (not shown) may be provided inside the cavity 32 for receiving the waste material 40 and for easier disposal of the waste material by simply replacing the plastic lining i.e. a plastic garbage bag.

Figure 4:
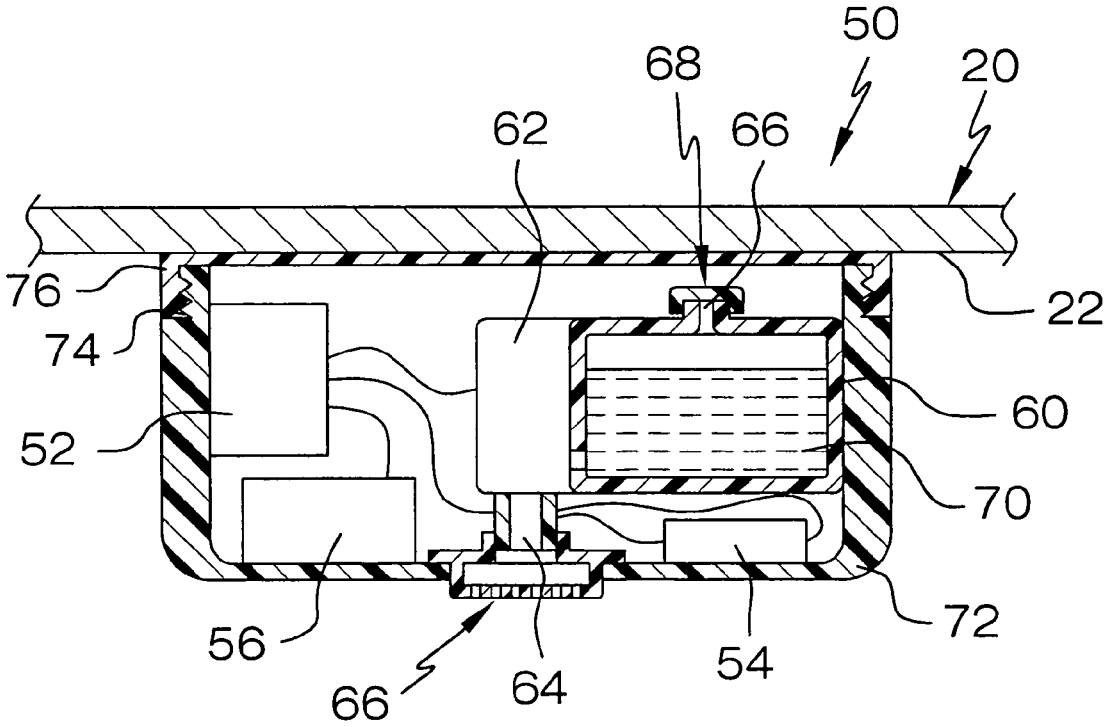
FIG. 4 is a cross-sectional view of the automatic deodorant dispensing system mounted in the present invention waste receptacle.

The present invention automatic deodorant dispensing system 50 is shown in a detailed, cross-sectional view in FIG. 4. The dispensing system 50 is mounted to a bottom surface 22 of the lid 20 by any one of a variety of mechanical means, such as by adhesive or by a loop-and-hoop means such as Velcro. The deodorant dispensing system 50, as shown in FIG. 4, is controlled by a microprocessor 52, a tilt switch 54 that are powered by a battery pack 56. The automatic deodorant dispensing system 50 is further provided with a deodorant reservoir 60, a motorized pump 62, a fluid passageway 64 and a nozzle 66. The microprocessor 52 further includes a timer which may be preset for a desirable time interval i.e. between 1 and 100 minutes for activating the motorized pump 62. A suitable time period may be 5 minutes or 10 minutes. The deodorant reservoir 60 is further provided with an opening 66 and a cap 68 such that the deodorant 70 contained in the reservoir 60 can be replenished when necessary.

It should be noted that the present invention automatic deodorant dispensing system is operative only when the mercury, or tilt switch 54 is in a closed circuit, or when the lid is in a closed or downward position such as that shown in FIG. 4. When the lid is in an upright position, such as that shown in FIG. 3, the automatic deodorant dispensing system 50 is non-operative or deactivated such that the deodorant 70 is not wasted by spraying into open air. This unique feature of the present invention allows the efficient use of the deodorant 70 and furthermore, allows the maximized effect of deodorization inside the cavity 32 of the waste receptacle 10.

As shown in FIG. 4, the upper end of the dispensing system housing 72 is provided with threads 74 such that the housing 72 can be easily disengaged from the base 76 of the dispensing system 50 when refill of the deodorant becomes necessary. In this configuration, the base 76 of the dispensing system 50 may be permanently mounted to the underside 22 of the lid 20 by an adhesive.

While the preferred embodiments of the invention have been described above, it will be recognized and understood that various modifications can be made in the invention and the appended claims are intended to cover all such modifications which may fall within the spirit and scope of the invention.

What is claimed is:

1. A waste receptacle equipped with an automatic deodorant dispensing system comprising:

a receptacle base for receiving waste material in a cavity;

a lid pivotably connected to a top portion of said receptacle base for hermetically sealing said cavity;

a deodorant dispensing system mounted to a bottom surface of said lid controlled by a tilt switch such that said deodorant dispensing system is operative only when said lid is in a down position; and said deodorant dispensing system further comprising a microprocessor, a battery pack, a deodorant reservoir, a motorized pump, a nozzle, and a tilt switch.

2. The waste receptacle according to claim 1, wherein said receptacle base and said lid are made of a metal.

3. The waste receptacle according to claim 1, wherein said receptacle base and said lid are made of plastic.

4. The waste receptacle according to claim 1, wherein said deodorant dispensing system is mounted to a bottom surface of the lid by an adhesive.

5. The waste receptacle according to claim 1, wherein said deodorant dispensing system further comprising a deodorant reservoir capable of being refilled after repeated use of the dispensing system.

6. The waste receptacle according to claim 1, wherein said deodorant dispensing system further includes a timer system such that a time interval between 1 minute and 100 minutes can be preset for spraying said deodorant.

7. The waste receptacle according to claim 1, wherein said tilt switch in said deodorant dispensing system is a mercury switch.

* * * * *